US008043165B2

(12) United States Patent
Galloway

(10) Patent No.: US 8,043,165 B2
(45) Date of Patent: Oct. 25, 2011

(54) SOLE FOR IRON GOLF CLUB HEAD

(75) Inventor: J. Andrew Galloway, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 107 days.

(21) Appl. No.: 12/616,503

(22) Filed: Nov. 11, 2009

(65) Prior Publication Data

US 2010/0130302 A1 May 27, 2010

Related U.S. Application Data

(60) Provisional application No. 61/117,030, filed on Nov. 21, 2008.

(51) Int. Cl.
*A63B 53/04* (2006.01)

(52) U.S. Cl. ..... 473/328; 473/349; 473/350

(58) Field of Classification Search ..... 473/324–350, 473/287–292; D21/747–752, 759
See application file for complete search history.

(56) References Cited

U.S. PATENT DOCUMENTS

| | | | | | |
|---|---|---|---|---|---|
| 1,505,296 | A | * | 8/1924 | Smith | 473/328 |
| D184,054 | S | * | 12/1958 | Huthsing | D21/751 |
| 3,068,011 | A | * | 12/1962 | Sano | 473/328 |
| 3,138,386 | A | * | 6/1964 | Onions | 473/328 |
| 3,897,065 | A | * | 7/1975 | Solheim | 473/349 |
| D239,550 | S | * | 4/1976 | Timbrook | D21/750 |
| 5,131,986 | A | | 7/1992 | Harada et al. | |
| 5,154,423 | A | * | 10/1992 | Antonious | 473/328 |
| 5,282,625 | A | * | 2/1994 | Schmidt et al. | 473/350 |
| 5,326,105 | A | * | 7/1994 | Fenton, Jr. | 473/328 |
| D352,082 | S | * | 11/1994 | Schroder | D21/748 |
| D371,181 | S | * | 6/1996 | Antonious | D21/748 |
| D371,183 | S | * | 6/1996 | Antonious | D21/748 |
| 5,531,444 | A | | 7/1996 | Buettner | |
| 5,626,530 | A | | 5/1997 | Schmidt et al. | |
| D393,676 | S | * | 4/1998 | Frazetta | D21/747 |
| 5,938,540 | A | * | 8/1999 | Lu | 473/288 |
| D426,603 | S | * | 6/2000 | Besnard et al. | D21/747 |
| 6,196,936 | B1 | | 3/2001 | Meckel | |
| 6,251,029 | B1 | * | 6/2001 | Roberts | 473/328 |
| 6,346,052 | B1 | | 2/2002 | Chappell | |
| 6,617,050 | B2 | | 9/2003 | Chao | |
| 6,638,179 | B2 | | 10/2003 | Yoshida | |
| 6,758,764 | B1 | | 7/2004 | Chen et al. | |
| 6,852,041 | B1 | | 2/2005 | Huang | |
| D503,203 | S | * | 3/2005 | Wood et al. | D21/747 |
| 7,025,694 | B2 | | 4/2006 | Huang | |
| 7,083,525 | B2 | | 8/2006 | Pond et al. | |
| 7,153,222 | B2 | | 12/2006 | Gilbert et al. | |
| 7,166,042 | B2 | | 1/2007 | Gilbert et al. | |
| 7,393,286 | B1 | * | 7/2008 | Renegar | 473/328 |
| D574,914 | S | * | 8/2008 | Oldknow et al. | D21/759 |
| D577,399 | S | * | 9/2008 | Oldknow et al. | D21/759 |
| D580,503 | S | * | 11/2008 | Roach et al. | D21/747 |
| D583,433 | S | * | 12/2008 | Oldknow et al. | D21/759 |
| 2002/0198062 | A1 | * | 12/2002 | McCabe et al. | 473/290 |
| 2008/0287215 | A1 | * | 11/2008 | Deng et al. | 473/349 |
| 2009/0082133 | A1 | * | 3/2009 | Tseng | 473/349 |

* cited by examiner

*Primary Examiner* — Sebastiano Passaniti
(74) *Attorney, Agent, or Firm* — Michael A. Catania; Rebecca Hanovice; Sonia Lari

(57) ABSTRACT

The present invention discloses an iron-type golf club head in which the sole portion has a main surface and a stepped surface. Further, the sole portion comprises a chromium coating. The invention creates a unique combination of head shape and surface friction coefficients that minimize the bad effects of turf impact.

5 Claims, 6 Drawing Sheets

SOLE FOR IRON GOLF CLUB HEAD

CROSS REFERENCES TO RELATED APPLICATIONS

The Present Application claims priority to U.S. Provisional Patent Application No. 61/117,030, filed on Nov. 21, 2008.

STATEMENT REGARDING FEDERALLY SPONSORED RESEARCH OR DEVELOPMENT

Not Applicable

BACKGROUND OF THE INVENTION

1. Field of the Invention

The present invention relates to an iron-type golf club head. More specifically, the present invention relates to a new sole design for an iron-type golf club head to improve turf contact and divot taking 2. Description of the Related Art The prior art discloses sole designs for golf club heads and chromium coating for durability and polishing irregularities. One invention that addresses sole design is U.S. Pat. No. 5,626,530 to Schmidt et al. for a Golf Club with Sole Bevel Indicia. The Schmidt et al. invention discloses an iron type golf club head having a sole which is beveled in order to provide an improved method for embossed numeral placement. The bevel of this invention is flat or substantially flat and inclined upwardly and rearwardly relative to the bottom of the sole. However, the Schmidt patent does not address the improvement of turf contact or desired mass properties.

U.S. Pat. No. 6,346,052 to Chappell discloses a hard chrome coating. The invention is an iron golf club with a multilayer construction having a soft nickel alloy core and a hard chrome coating. However, the chrome coating is used to address the problem of durability and polishing inconsistencies which occur during the manufacturing process. The purpose of the invention is to provide a multilayer design which is durable and consistent from club to club with enhanced feel characteristics. The patent does not address the problem of reducing friction.

U.S. Pat. No. 5,531,444 to Buettner discloses a golf club head which is coated with a hard coating of titanium nitride. The patent addresses the method of coating the golf club using tapered pins inserted into golf club hosel bores, which enables the club head to be coated at elevated temperatures without distorting the hosel bores. It does not discuss the capabilities of the coating to reduce friction and enhance golf play.

The golf club sole and the leading edge have meaningful effects on how well the club head maintains speed and direction. For many clubs and shots it is desirable to impact the ball just before the club down swing is complete, this to achieve improved spin for the situation. To achieve this, the club has to contact the ball and transfer energy to the ball near simultaneously with the turf Should the club pass through the turf before the energy is transferred to the ball, the ball speed and spin are diminished.

Also, on contact with the turf, particularly in a downward hit, the impact can be felt as harsh by the golfer. Some golfers become timid about swinging the club toward the turf and attempt to pick the ball off the turf without contact. In general, a divot is taken to allow the club head to contact the ball in the most advantageous orientation. Contacting the ball just prior to the ground is the intent, but for most golfers there are errors in delivering the ball. It is preferable that the club head's path follow through the turf. Often the club head impacts the turf before the ball due to variation in the swing path and, or because the ball lies in the turf such that ball and turf must be hit for the most advantage.

BRIEF SUMMARY OF THE INVENTION

The present invention resolves the problems of the prior art.

Golfers gain advantage by reducing variation of the ball flight. Executing the required swing and impact is necessary for the best results. The mass properties of the club head are tailored to minimize the impact of variations in the swing. Common faults and common expectations can be identified and details of the club design such as mass properties and the geometry of the head are used to better serve the identifiable segments. The mass properties designer to better an identified segment can be achieved in various geometries and constructions. These geometries also affect the many other properties of the club head. This invention enables the construction of club heads that simultaneously improve geometry driven mass properties, aesthetic appeal and forces during impact. Some of the impact forces degrade the head, ball impact orientation and speed. Impact can also result in harshness felt in the golfer's hands.

The purpose of this invention is to minimize the impact variations, allow preferred geometries for specific mass properties, turf impact and functional and aesthetic appeal.

One aspect of the present invention is an iron-type golf club head having a front wall and sole portion, in which the sole portion extends rearward from the front wall. The sole was also has a main surface and a stepped surface.

Another aspect of the present invention is an iron-type golf club head with a body composed of a stainless steel material and having a front wall and a sole portion. The sole portion extends rearward from the front wall and has a main surface, stepped surface and an edge between the main surface and the stepped surface. The sole portion has a length which ranges from 7.5 cm to 10.0 cm and a width which ranges from 1.0 cm to 4.0 cm. The main surface has a width that ranges from 1.0 cm to 2.5 cm and the stepped surface has a width that ranges from 0.25 cm to 1.5 cm. The edge between the main surface and the stepped surface has a height that ranges from 0.3 cm to 0.5 cm.

Yet another aspect of the present invention is an iron-type golf club head which comprises a body composed of a stainless steel material, a front wall, a hosel, a heel portion, a toe portion, a top portion and a sole portion. The heel portion, the toe portion, the top portion and the sole portion define an external rear cavity. The sole portion extends rearward from the front wall and has a main surface, stepped surface and an edge between the main surface and the stepped surface. The sole portion has a length that ranges from 7.5 cm to 10.0 cm and a width that ranges from 1.0 cm to 4.0 cm. The main surface has a width that ranges from 1.0 cm to 2.5 cm and the stepped surface has a width that ranges from 0.25 cm to 1.5 cm. The edge has a height that ranges from 0.3 cm to 0.5 cm.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
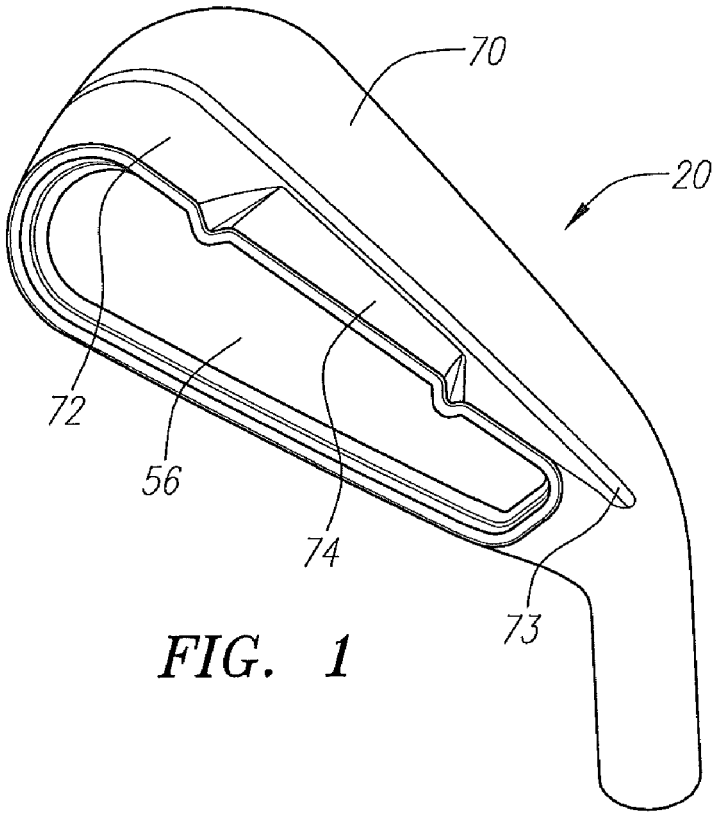
FIG. 1 is a perspective view of an iron golf club head.
Figure 2:
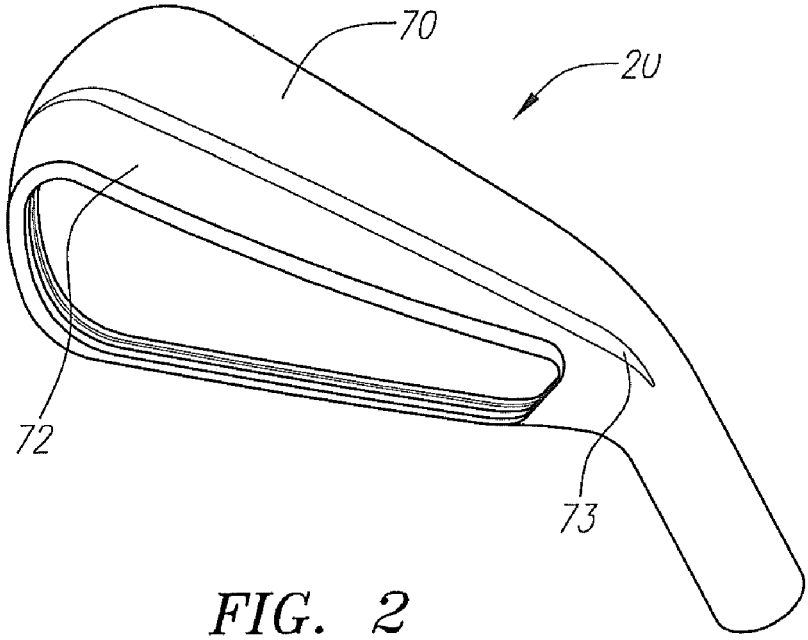
FIG. 2 is a perspective view of an iron golf club head.
Figure 3:
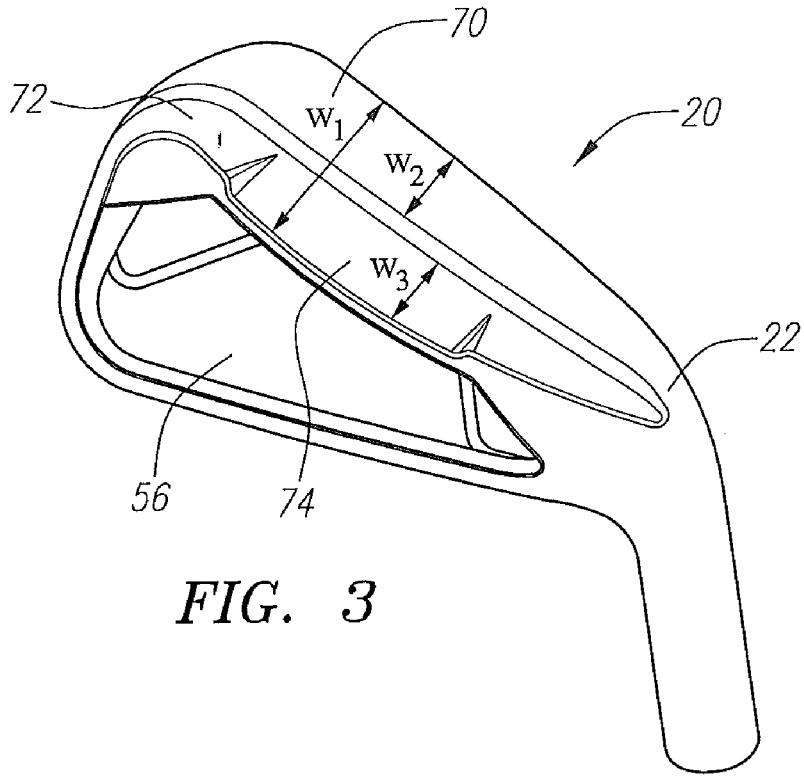
FIG. 3 is a perspective view of an iron golf club head.
Figure 4:
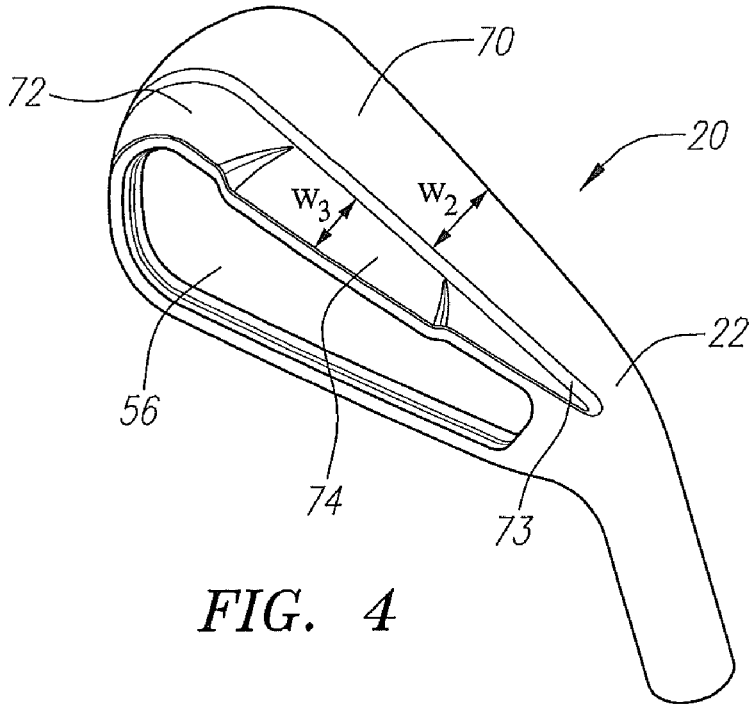
FIG. 4 is a perspective view of an iron golf club head.
Figure 5:
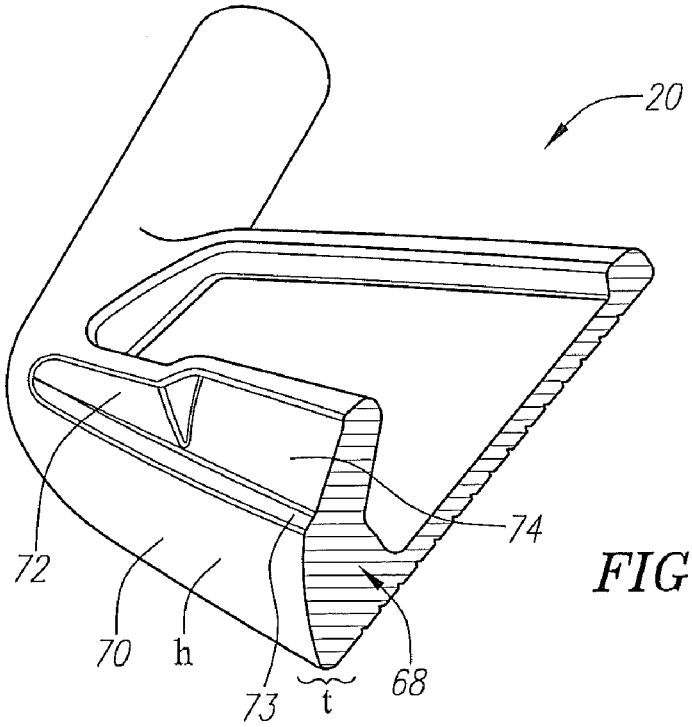
FIG. 5 is a partial cross-sectional view of an iron golf club head.
Figure 6:
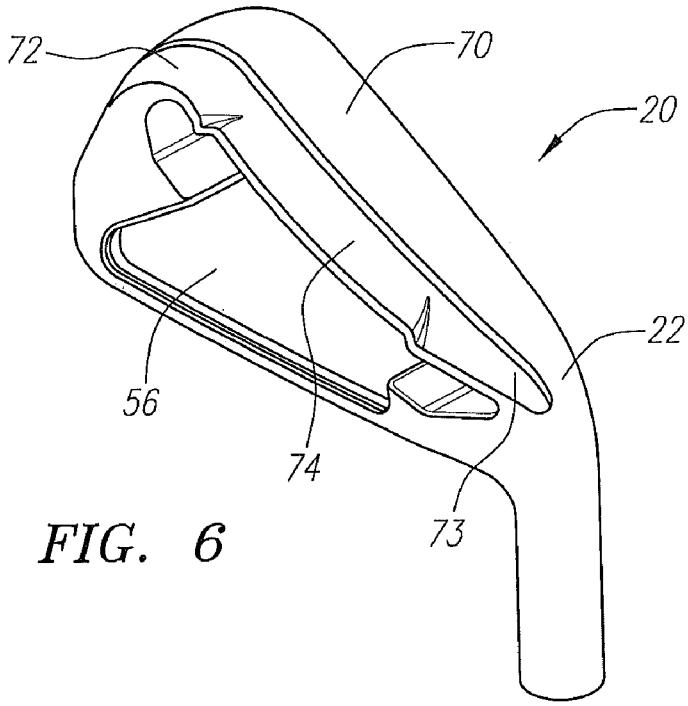
FIG. 6 is a perspective view of an iron golf club head.
Figure 7:
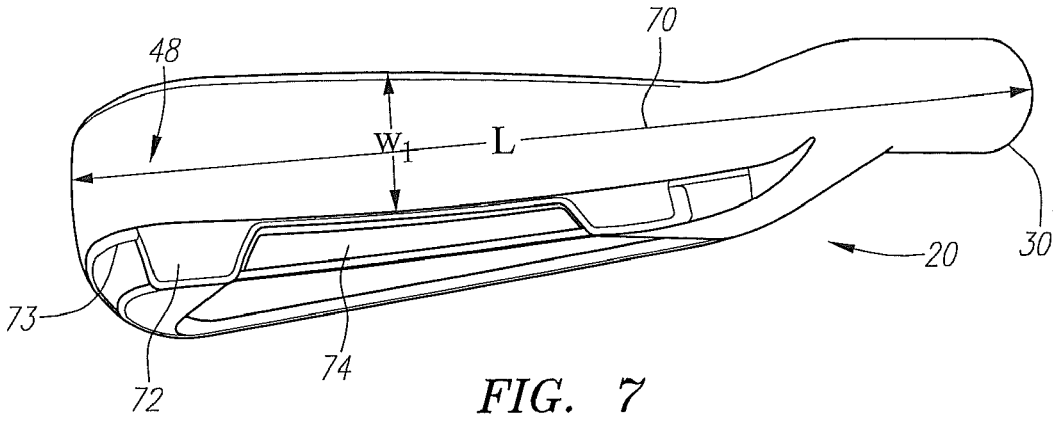
FIG. 7 is a bottom plan view of an iron golf club head.
Figure 8:
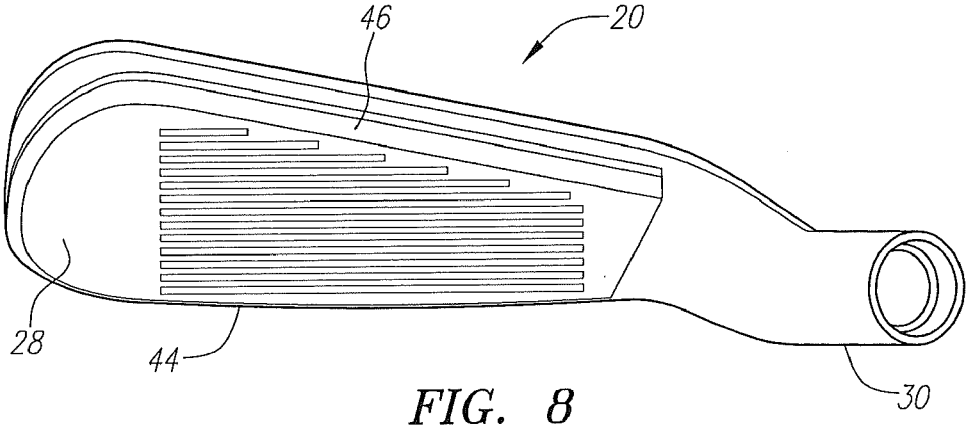
FIG. 8 is a top plan view of an iron golf club head.
Figure 9:
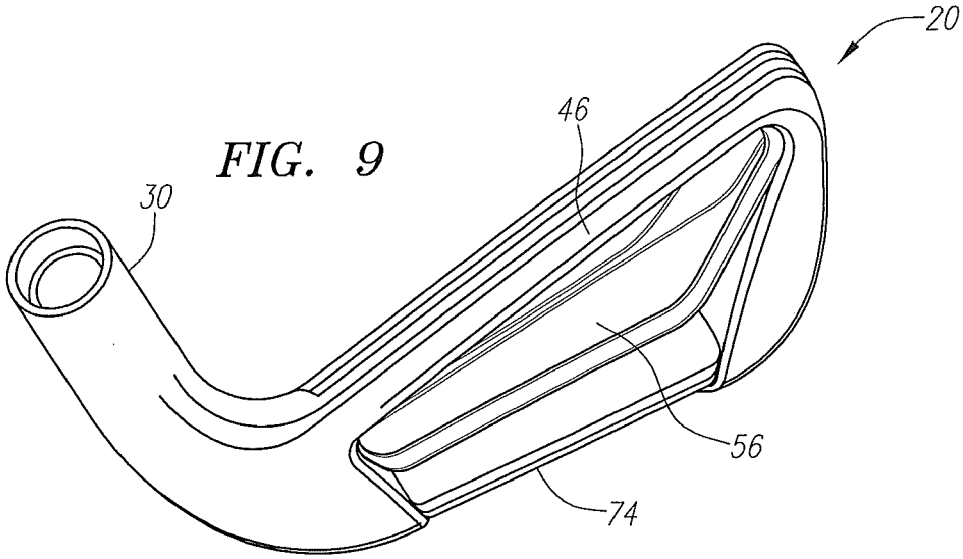
FIG. 9 is a top plan view of an iron golf club head.
Figure 10:
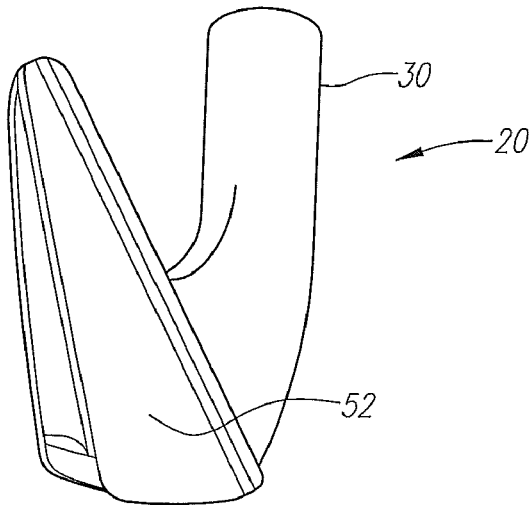
FIG. 10 is toe end view of the iron golf club head.
Figure 11:
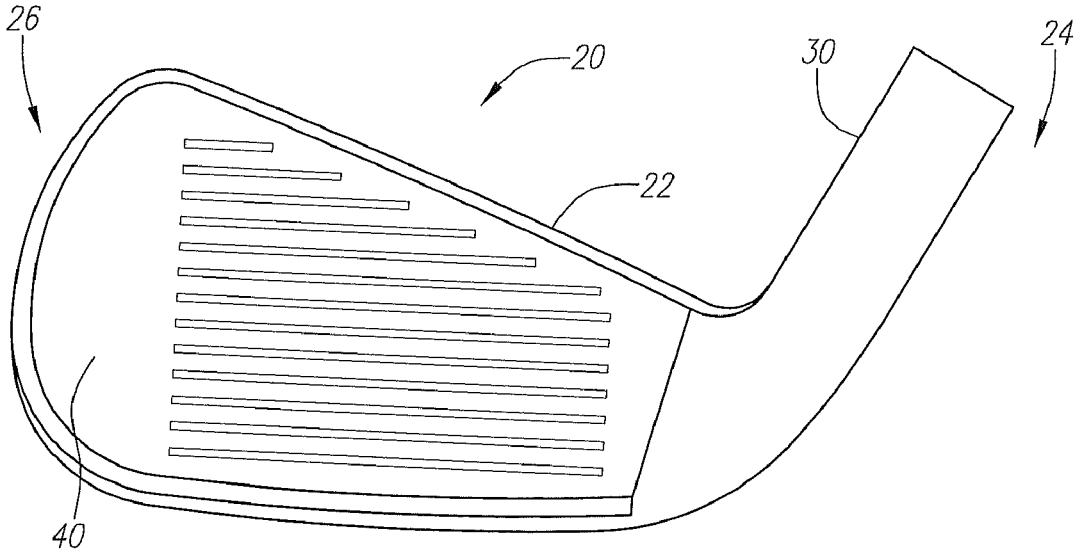
FIG. 11 is a frontal view of an iron golf club head.
Figure 12:
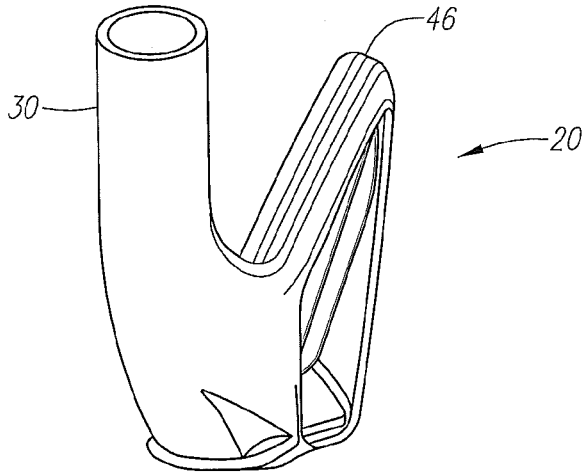
FIG. 12 is a heel end view of an iron golf club head.
Figure 13:
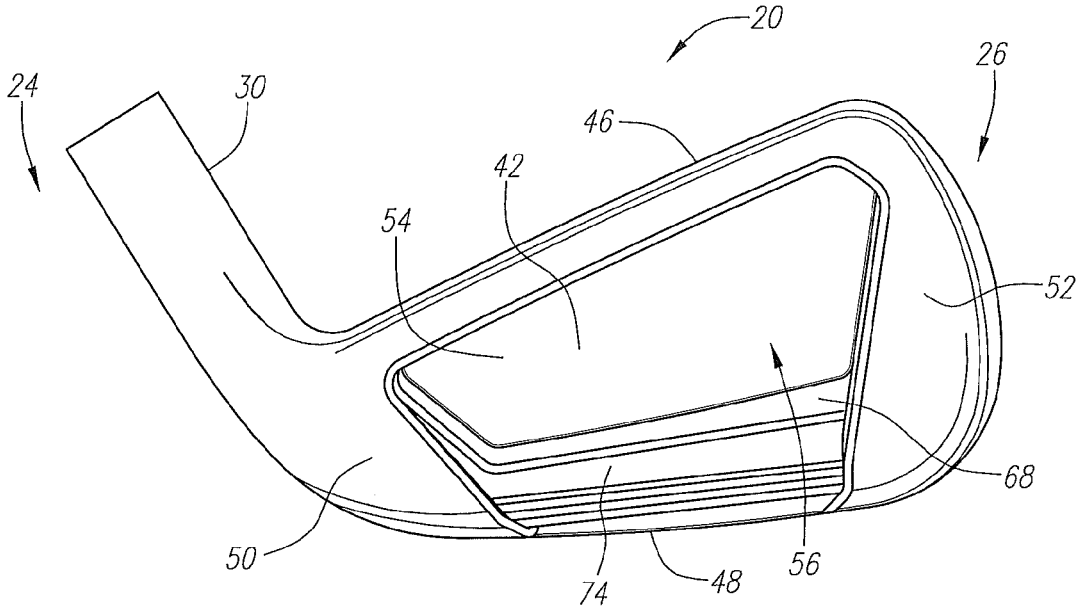
FIG. 13 is a rear view of an iron golf club head.

As shown in FIGS. 1-13, an iron-type golf club head in accordance with the present invention is generally designated 20. The club head 20 is a cavity-back iron and includes a body 22 having a heel end 24 and a toe end 26. The body 22 has a front wall 28 for contacting a golf ball and a hosel 30 for receiving a shaft, not shown. In a preferred embodiment the golf club head 20 is composed of a stainless steel, however, those of ordinary skill in the art will appreciate that the golf club head 20 may also be composed of other materials, such as carbon steel, titanium, titanium alloy, zirconium or zirconium alloy.

The front wall 28 of golf club head 20 has a ball-striking surface 40 and a back surface 42. The ball-striking surface 40 has a plurality of scorelines 44 formed therein. In a preferred embodiment the top of the hosel 30 is lower than the toe end of the front wall 28, thereby lowering the center of gravity of the club head 20.

The golf club head 20 also has a top portion 46, a sole portion 48, a heel portion 50, a toe portion 52 and a rear surface 54. The top wall 46 extends rearward from the top end of the front wall 28, in a direction opposite the ball-striking surface 40, to the rear surface 54 of the body 22. The sole portion 48 extends rearward from the bottom end of the front wall 28 to the rear surface 54. The heel portion 50 extends rearward from the heel end 24 of the front wall 28 to the rear surface 54, and the toe portion 52 extends rearward from the toe end 26 of the front wall 28 to the rear surface 54. The rear surface 54, the top portion 46, the sole portion 48, the heel portion 50 and the toe portion 52 define an external rear cavity 56 in the body 22 of the club head 20. The top portion 46, the sole portion 48, the heel portion 50 and the toe portion 52 also provide the club head 20 with perimeter weighting to make the club head more forgiving and provide better performance for the typical golfer.

The golf club head 20 preferably includes an undercut recess 68 in communication with the external rear cavity 56. The undercut recess 68 preferably circumscribes the external rear cavity 56. Alternatively, the undercut recess 68 may extend along only a portion of the external rear cavity 56. A medallion, not shown, is preferably disposed in the external rear cavity 56 of the body 22.

As shown in FIGS. 1-13, the present invention creates a geometry that is aesthetically pleasing, consistent with the best mass properties and accommodating to the golfers interest in sole shapes that minimize interference between the turf and club head. This is accommodated by combining features of better player clubs and with improving player clubs. The radius of the face to sole transition is designed to be a smaller radius to maximize the extension of the flat face within the ball contact locations. Also the radius design penetrates the turf better than a more blunt face to sole transition.

The sole is extended away from the face to improve the mass properties of the center of mass, the mass distribution, appeal, and for clearance between the club head and the turf during the follow through of the swing. The sole is stepped such that the sole surface furthest from the face is raised away from the turf to minimize the turf contact through the swing particularly for the longer, less lofted "irons". The surface friction is reduced by applying a thin dense chromium coating thorough electroplating.

The appeal of the step and associated geometry is detailed for both appearance and preferential shape.

The invention creates a unique combination of head shape and surface friction coefficients that minimize the bad effects of turf impact. The step geometry is also aesthetically advantageous.

An iron-type golf club head in accordance with the present invention is generally designated. One aspect of the present invention is an iron-type golf club head 20 having a front wall 28 and sole portion 48, in which the sole portion 48 extends rearward from the front wall 28. The sole 48 also has a main surface and a stepped surface. Further, the sole 48 comprises a chromium coating wherein some instances the chromium coating is electroplated.

In a preferred embodiment, the face to sole transition has a minimal radius. The sole portion 48 has a length (L) that ranges from 7.5 cm to 10.0 cm and a width (W1) that ranges from 1.0 cm to 4.0 cm. The sole portion 48 has a thickness (t) ranging from 1.5 cm to 2.0 cm. The main surface of the sole portion 48 has a width (W2) that ranges from 1.0 cm to 2.5 cm. The stepped surface of the sole portion 48 has a width (W3) that ranges from 0.25 cm to 1.5 cm. In one embodiment, the stepped surface of the sole portion 48 further comprises a notch recess. Further, the sole portion 48 comprises an edge between the main surface and the stepped surface and the edge of the sole portion has a height (h) that ranges from 0.3 cm to 0.5 cm.

Another aspect of the present invention is an iron-type golf club head 20 with a body 22 composed of a stainless steel material and having a front wall 28 and a sole portion 48. The sole portion 48 extends rearward from the front wall 28 and has a main surface, stepped surface and an edge between the main surface and the stepped surface. The sole portion 48 has a length (L) which ranges from 7.5 cm to 10.0 cm and a width (W1) which ranges from 1.0 cm to 4.0 cm. The main surface has a width (W2) that ranges from 1.0 cm to 2.5 cm and the stepped surface has a width (W3) that ranges from 0.25 cm to 1.5 cm. The edge between the main surface and the stepped surface has a height (h) that ranges from 0.3 cm to 0.5 cm.

Yet another aspect of the present invention is an iron-type golf club head 20 which comprises a body 22 composed of a stainless steel material and has a front wall 48, a hosel 30, a heel portion 50, a toe portion 52, a top portion 46 and a sole portion 48. The heel portion 50, the toe portion 52, the top portion 46 and the sole portion 48 define an external rear cavity. The sole portion 48 extends rearward from the front wall 28 and has a main surface, stepped surface and an edge between the main surface and the stepped surface. The sole portion 48 has a length (L) that ranges from 7.5 cm to 10.0 cm and a width (W1) that ranges from 1.0 cm to 4.0 cm. The main surface has a width (W2) that ranges from 1.0 cm to 2.5 cm and the stepped surface has a width (W3) that ranges from 0.25 cm to 1.5 cm. The edge has a height (h) that ranges from 0.3 cm to 0.5 cm. In a preferred embodiment, body further comprises an undercut recess.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. An iron-type golf club head comprising:

a body having a front wall and a sole portion, the sole portion extending rearward from the front wall and having a main surface, stepped surface and an edge between the main surface and the stepped surface, the edge substantially perpendicular to the main surface, the stepped surface extending along a length of the main surface and having a center notch recess;

wherein the sole portion has a length that ranges from 7.5 cm to 10.0 cm, a width that ranges from 1.0 cm to 4.0 cm, and a thickness ranging from 1.5 cm to 2.0 cm;

wherein the main surface of the sole portion has a width that ranges from 1.0 cm to 2.5 cm and a width that ranges from 0.25 cm to 1.5 cm; and wherein the edge of the sole portion has a height that ranges from 0.3 cm to 0.5 cm.

2. The iron-type golf club head according to claim 1 wherein the iron-type golf club head is composed of a metal material selected from the group of stainless steel and titanium alloy.

3. The iron-type golf club head according to claim 1 wherein the sole further comprises a chromium coating.

4. The iron-type golf club head according to claim 3 wherein the chromium coating is electroplated.

5. The iron-type golf club head according to claim 1 wherein the stepped surface of the sole portion has a width ranging from 0.25 cm to 1.5 cm.

* * * * *